US005947255A

United States Patent [19]

Shimada et al.

[11] Patent Number: 5,947,255

[45] Date of Patent: Sep. 7, 1999

[54] METHOD OF DISCRIMINATING PAPER NOTES

[75] Inventors: Hironori Shimada; Toshimitsu Kozuki, both of Himeji, Japan

[73] Assignee: Glory Kogyo Kabushiki Kaisha, Hyogo, Japan

[21] Appl. No.: 08/834,210

[22] Filed: Apr. 15, 1997

[30] Foreign Application Priority Data

Apr. 15, 1996 [JP] Japan ..... 8-115245

[51] Int. Cl.[6] ..... G07D 7/00

[52] U.S. Cl. ..... 194/207; 250/556; 382/135

[58] Field of Search ..... 194/206, 207; 209/534; 356/71; 382/135; 250/556

[56] References Cited

U.S. PATENT DOCUMENTS 5,199,543 4/1993 Kamagami et al. ..... 194/207

5,462,149 10/1995 Waine et al. ..... 194/206

5,737,418 4/1998 Saffari et al. ..... 194/207

*Primary Examiner*—F. J. Bartuska

*Attorney, Agent, or Firm*—Wenderoth, Lind & Ponack, L.L.P.

[57] ABSTRACT

The present invention provides a discrimination method which reduces memory size and validate bills at a high speed. According to the present invention, reflected light or transmitted light from a paper note is received by an image sensor, image data is stored in a memory device, a region of the paper note is cut out from the image data in the memory device, the cut-out paper note image data is blocked and normalized, and a bit corresponding to the blocked value is turned on, the block paper note image data is encoded into pattern data, and the compression-coded pattern data is compared with prestored reference paper note pattern data to discriminate the paper note.

9 Claims, 11 Drawing Sheets

FIG.10A
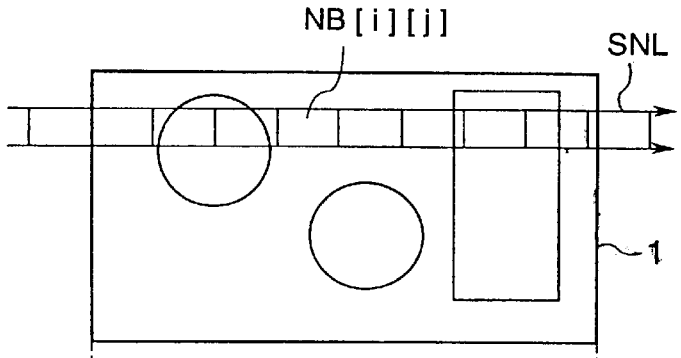
FIG.10B
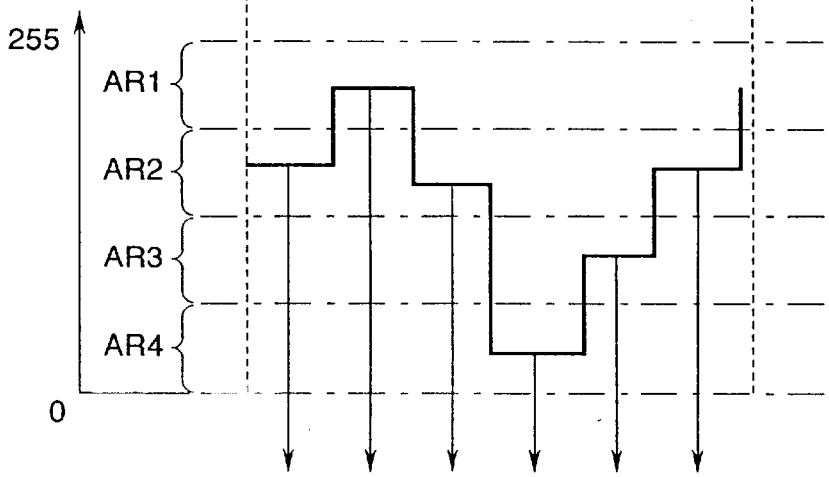
FIG.10C
| | | | | | |
|---|---|---|---|---|---|
| 0 | 1 | 0 | 0 | 0 | 0 |
| 1 | 0 | 0 | 0 | 0 | 1 |
| 0 | 0 | 1 | 0 | 1 | 0 |
| 0 | 0 | 0 | 1 | 0 | 0 |

METHOD OF DISCRIMINATING PAPER NOTES

BACKGROUND OF THE INVENTION

1. Field of the Invention

The present invention relates to a paper note discrimination method which facilitates identification processing by efficiently compressing and encoding the image data of paper notes such as bills (paper money) and checks when discriminating the paper notes.

2. Description of the Prior Art

In conventional bill discrimination machines equipped with an image line sensor for collecting the image data of the entire surface of a bill and performing the bill discrimination, in the case where an attempt is made to discriminate not only three types of Japanese bills but also foreign bills at the same time, there is a bill discrimination machine where reference image data, usually called a template, is prepared and where the reference image data and the image data of another bill to be discriminated are compared to judge the paper money type, direction of transport, and authenticity.

However, in such a conventional general discrimination method, the data of a minute area is processed to perform an accurate identification, as described for example in Japanese Patent Laid-Open No. 260187/1992. Also, in the case where optical data is employed, it is conditioned in many cases that the value of the optical data does not exceed the upper limit of a reference value and that such optical data is greater than the lower limit of the reference value. In addition, since a large quantity of data are processed for the bill, there are many cases where an image area predetermined for each type of paper money is specified to raise a processing speed and where the features of only that area are extracted to judge the paper money type or the like.

In the aforementioned discrimination methods, in the case where the number of types of the bills to be handled is increased, the respective specified areas are different and there is the need to find out the specified area for each bill, so there is the problem that additional time for development to find out specified area for each bill is required. Also, resolving the image data into multiple values has become one of the main causes which lengthens the processing time. Furthermore, in the case where there is the need to discriminate a variety of bills with the same discrimination machine, there is a desire for a paper notes discrimination method which reduces a requisite memory size and yet can perform the bill discrimination at a high speed.

SUMMARY OF THE INVENTION

The present invention has been made in view of the aforementioned circumstances, and an object of the present invention is to provide a discrimination method which discriminates a denomination for bills at a high speed, while reducing a memory size and data quantity by performing efficient data compression encoding. Another object of the present invention is to provide a discrimination method where an addition or a change of new paper money type to be discriminated is possible so that learning can be performed in a short time, even in the case where the discrimination of unregistered bills is added or the case where a new banknote was issued, by learning a reference encoding pattern for discrimination at the same time.

The present invention relates to a discrimination method used for discriminating paper notes, and the aforementioned objects are achieved by method of discriminating a paper notes, comprising the steps of: receiving reflected light or transmitted light from the paper note by an image sensor and storing the image data in a memory device; cutting out a region of the paper note from the image data in the memory device; pre-processing the cut-out paper note data to divide it into blocks; compression-encoding the pre-processed data for each block to form pattern data; and comparing the compression-coded pattern data with prestored paper note pattern data to discriminate the paper note.

In addition, the level of the image data is determined to a level of predetermined divided levels, by a binary compression-encoding process where a value of "1" or "0" represents a divided level. Therefore, the aforementioned objects can be more effectively achieved. By obtaining reference paper note pattern data by a learning process, new paper notes can be quickly added or changed.

BRIEF DESCRIPTION OF THE DRAWINGS

In the accompanying drawings:

FIGS. 10A to 10C are diagrams for explaining the compression encoding of the image data of the present invention;

DETAILED DESCRIPTION OF THE PREFERRED EMBODIMENTS

In bill discrimination machines for discriminating a wide variety of currency denominations in many countries, if the amount of discriminating data which becomes a reference for the comparison becomes smaller by reducing the amount of data to be handled, then the time required for discrimination per paper money type will be reduced. Reducing data size is required necessarily for quickly performing the processing. The present invention, in the bill discrimination machines to which 15 sheets of bills per second are conveyed, provides a discrimination method which achieves simultaneous discrimination of 304 patterns (76 paper money types and four directions) while sampling the image data of the entire surface of the bill.

A preferred embodiment of the present invention will hereinafter be described in detail based on the drawings.

Figure 1:
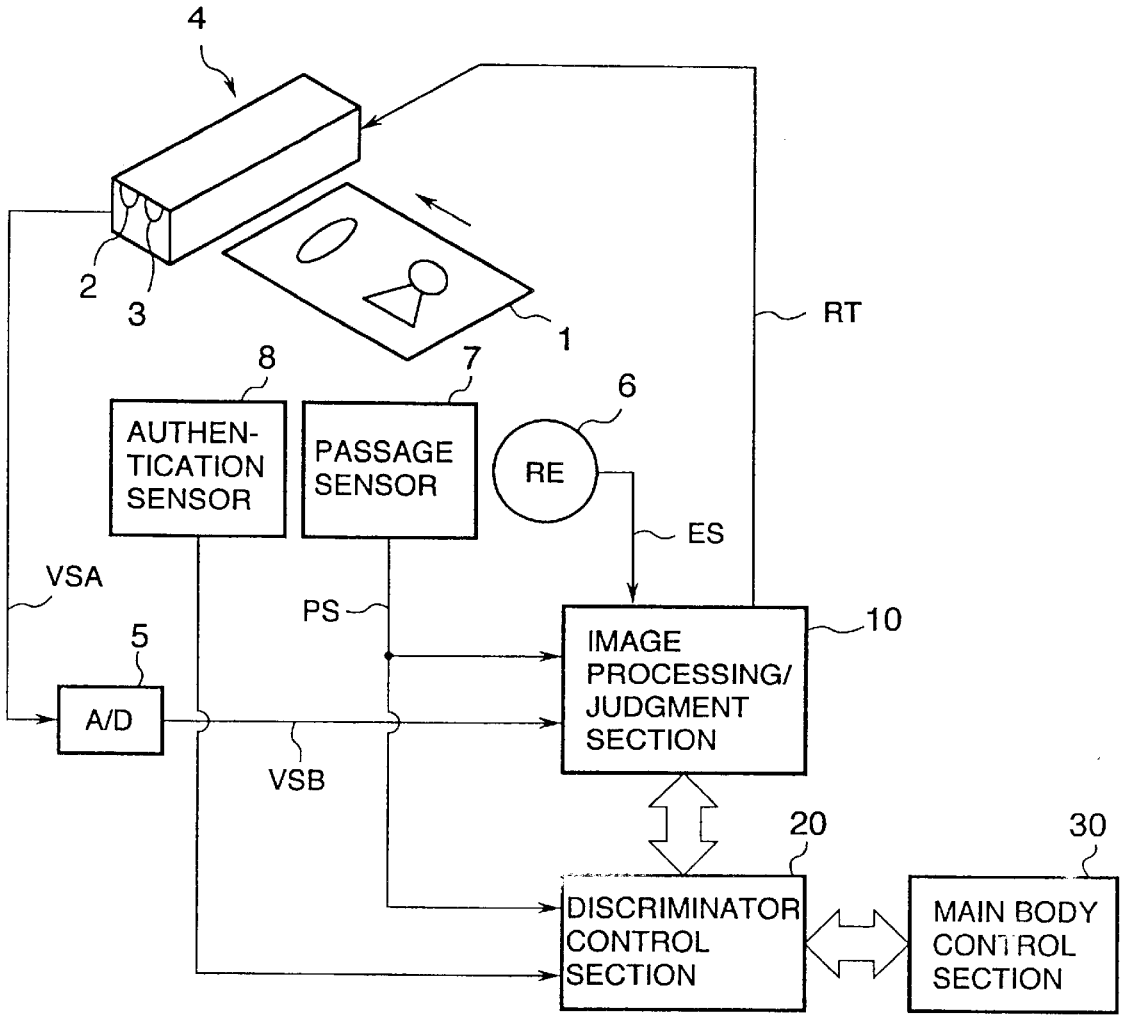
FIG. 1 is a block diagram to show an example of a bill discrimination apparatus of the present invention.

FIG. 1 shows an example of a bill discrimination apparatus for carrying out a discrimination method of the present invention. A bill 1 is conveyed through the under surface passageway of a sensor module 4, which is formed integrally with light emitting means 2 consisting of a light emitting diode array and with a line sensor 3 as light receiving means for receiving the light reflected from the bill 1. The analog video signal VSA from the line sensor 3 is converted to a 8-bit digital video signal VSB by an A/D converter 5 and is inputted to an image processing/judgment section 10. The details of the image processing/judgment section 10 are as shown in FIG. 2.

In the image processing/judgment section 10, the video signal VSB is accumulated in a FIFO (First-In First-Out) memory 11 and the video signal also is sequentially transferred and written to a selected region of a main memory (double buffers) 12 via the correcting section 101 in a digital signal processor (DSP) 100. The DSP 100 cooperates with a ROM 110 in which control programs are stored to develope the image data of the amount of a bill in the main memory 12. The DSP 100 has a blocking and compression encoding section 102 which blocks and compression-encodes the video signal VSB which is inputted via the FIFO memory 11, and also has a comparison/judgment control section 103 which outputs a judgment result DR. Also, the image processing/judgment section 10 has a flash memory 13 for reference-code patterns in which the reference-code patterns for various bills are stored. The reference-code pattern RC and the compressed and encoded data CS of a discriminated bill which is from a part of the main memory 12, are compared at the comparison/judgment control section 103, and the judgment result DR is outputted. The image processing/judgment section 10 performs data communication with a discriminator control section 20 which controls a discriminator (bill validator) through a dual port RAM 14. Note that the flash memory 13 is an electrically rewritable read-only memory and that the main memory 12 functions as double buffers and is a RAM having an image data memory, a work area memory, etc.

Furthermore, the image processing/judgment section 10 has a reading control section 15. The reading control section 15 performs the on-and-off control of the light emitting means 2, receives a mechanical clock signal ES from a rotary encoder 6 used for determining the scanning interval of the line sensor 3 when the bill 1 is conveyed, performs the read-out control of the A/D converter 5, performs the data write-in control of the FIFO memory 11, and generates a read control timing RT of the line sensor 3. On the conveying path for the bill 1, a passage sensor 7 for sensing passage of the bill 1 and an authentication (detects genuine or counterfeit notes) sensor 8 for sensing genuine or counterfeit bills are installed. The passage signal PS from the passage sensor 7 is inputted to the reading control section 15 within the image processing/judgment section 10 and also is inputted to the discriminator control section 20. The sensed signal from the authentication sensor 8 is also inputted to the discriminator control section 20. The discriminator control section 20 is connected to the image processing/judgment section 10 and also is connected to the main body control section (e.g., upper device controller) 30 such as a bill payment processor.

Figure 2:
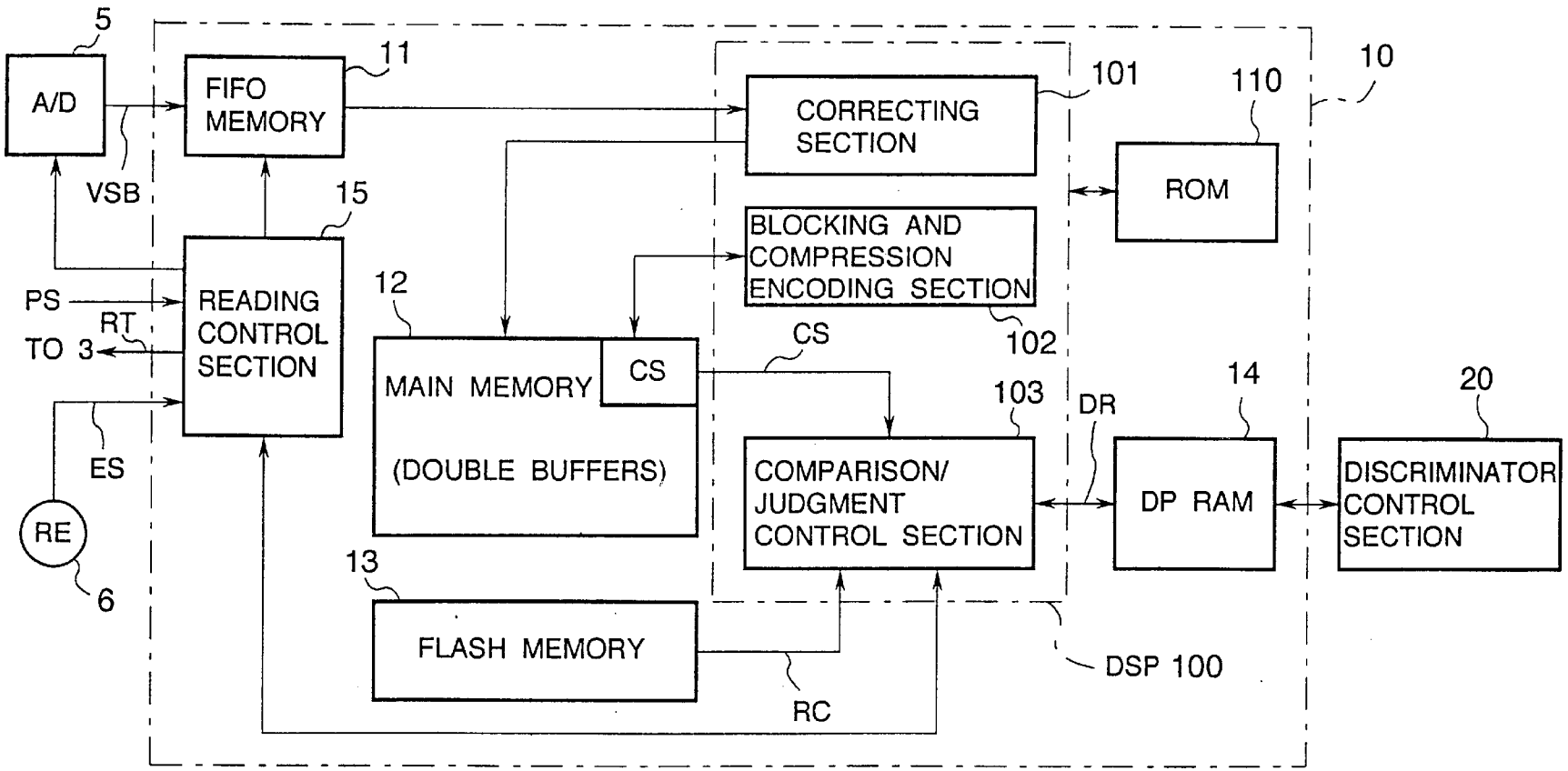
FIG. 2 is a block diagram to show the details of an image processing judgment section in FIG. 1.
Figure 3:
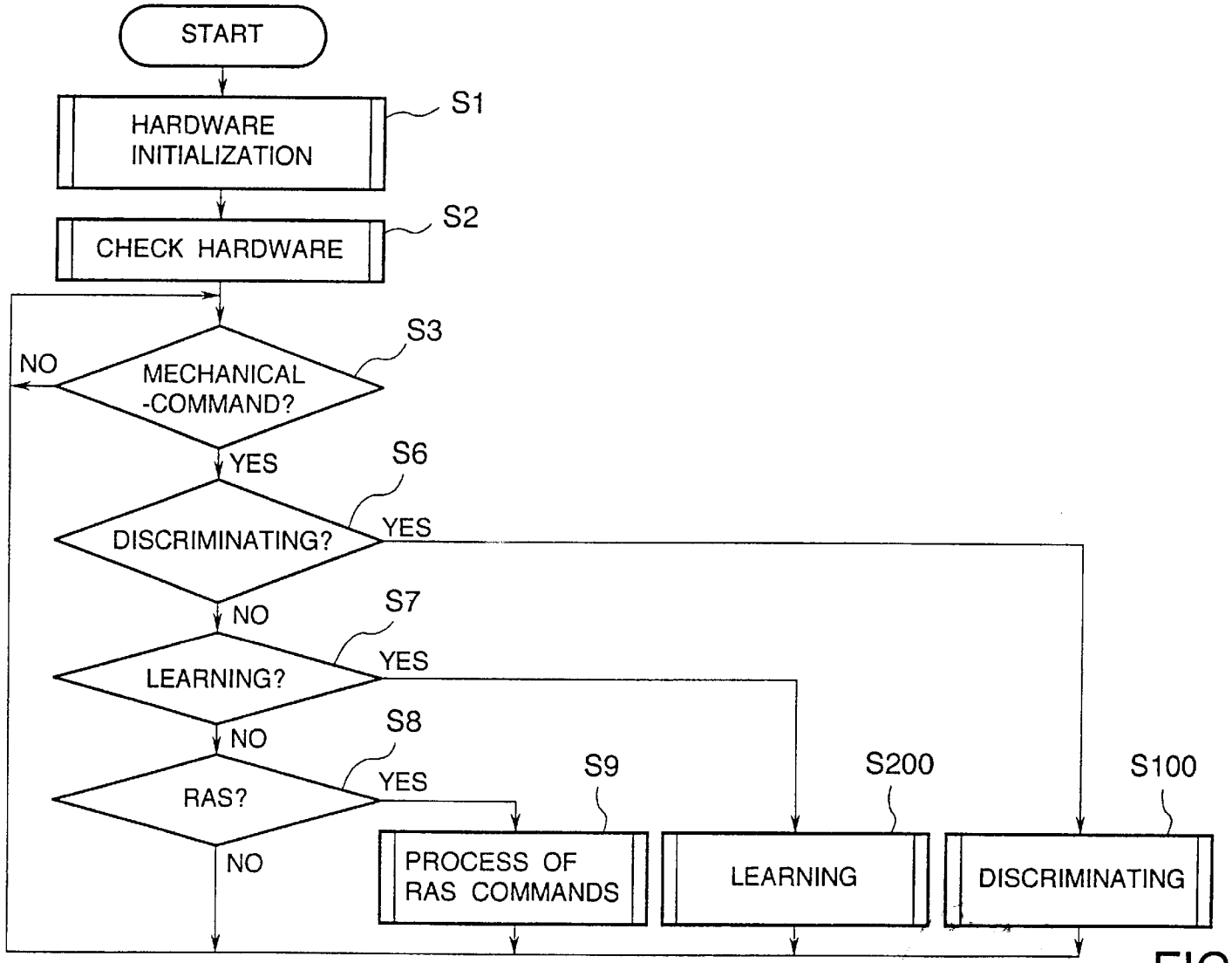
FIG. 3 is a flow chart to show an example of the entire operation of the present invention.

FIG. 3 is a flow chart showing the operation of the example of the DSP 100 within the image processing/judgment section 10 in FIGS. 1 and 2. First, the initialization required for hardware, such as a bill conveying mechanism, is performed (Step S1), and it is checked if there is nothing abnormal in the state of the hardware (Step S2). Thereafter, the hardware is put in a mechanical-command waiting state. If the mechanical-command is inputted and a start of the operation is instructed by a host CPU which is in the discriminator control section 20 (Step S3), it is judged whether the command is a start of discrimination or not (Step S6). In the case of the discrimination, the discrimination is performed (Step S100). When it is not the discrimination command at the Step S6, it is judged whether it is a start of learning or not (Step S7). In the case of the learning, the learning is performed (Step S200). When the command is not the start of the learning at the Step S7, it is judged if the command is the setting of RAS mode which is the mode that can run a special program created for a test or an evaluation (Step S8). In the case of the setting of the RAS mode, various RAS commands are processed (Step S9). "RAS" is an abbreviation of "Reliability, Availability and Serviceability". In the case where the command is not the setting of the RAS mode in the aforementioned Step S8, the Step S9 returns to the aforementioned Step S3 after various commands are processed. Also, the Step S200 and Step S100 return to the aforementioned Step S3 after the learning is processed and after the identification is processed, respectively.

Figure 4:
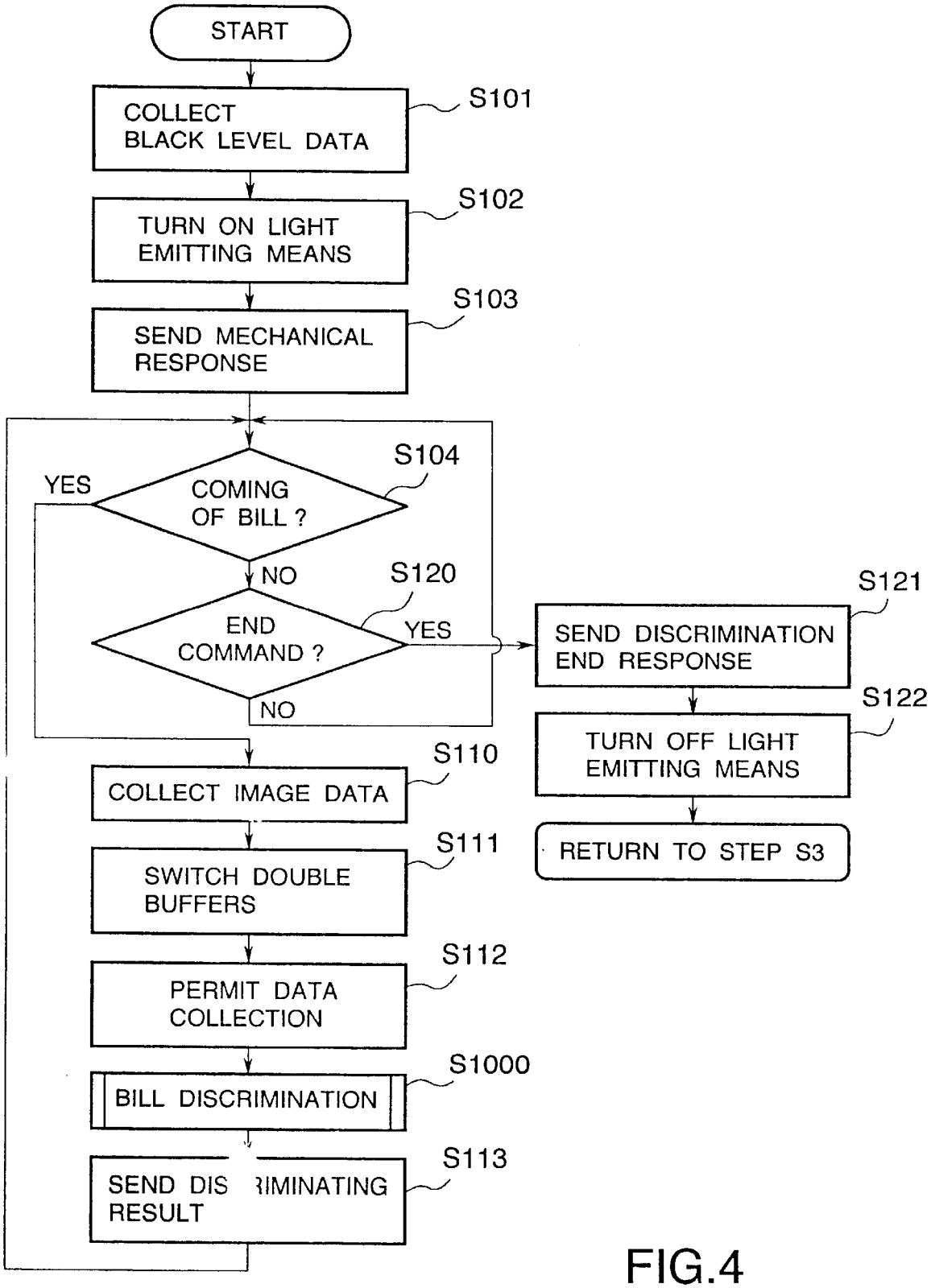
FIG. 4 is a flow chart showing an example of the discriminating operation of the present invention.

FIG. 4 is a flow chart to show an example of the detailed operation of the aforementioned discriminating process (Step S100). If the discriminating process is started, black level data, which is dark-time output data, is collected (Step S101) by reading out the output of the line sensor 3 in the state when the LED of the light emitting means 2 is turned off, in order to first collect the output of the line sensor 3. Thereafter, the light emitting means 2 is turned on (Step S102), and sending of a mechanical response is executed (Step S103) by writing a discrimination preparation completion response to the dual port RAM 14 and generating an interruption to inform to the host CPU. Next, if a passage of the bill 1 is sensed by the passage sensor 7, the passage signal PS upon arrival of the bill sets the reading control section 15 active (Step S104), and the video signal VSA from the line sensor 3 is converted from its analog value to a digital value VSB by the A/D converter 5 and the digital value VSB is written in the FIFO memory 11. Thereafter, the video digital signal VSB is corrected by the correcting section 101 in the DSP 100, and the result is written in one of the double buffers of the main memory 12. The line sensor 3 performs collection of the image data (Step S110), while the correction is being executed in the correcting section 101 by using the black level data fetched and processed when the discrimination is started and also using the white level data and black level data which have been written in the flash memory 13 by previously executing a program.

Figure 5:
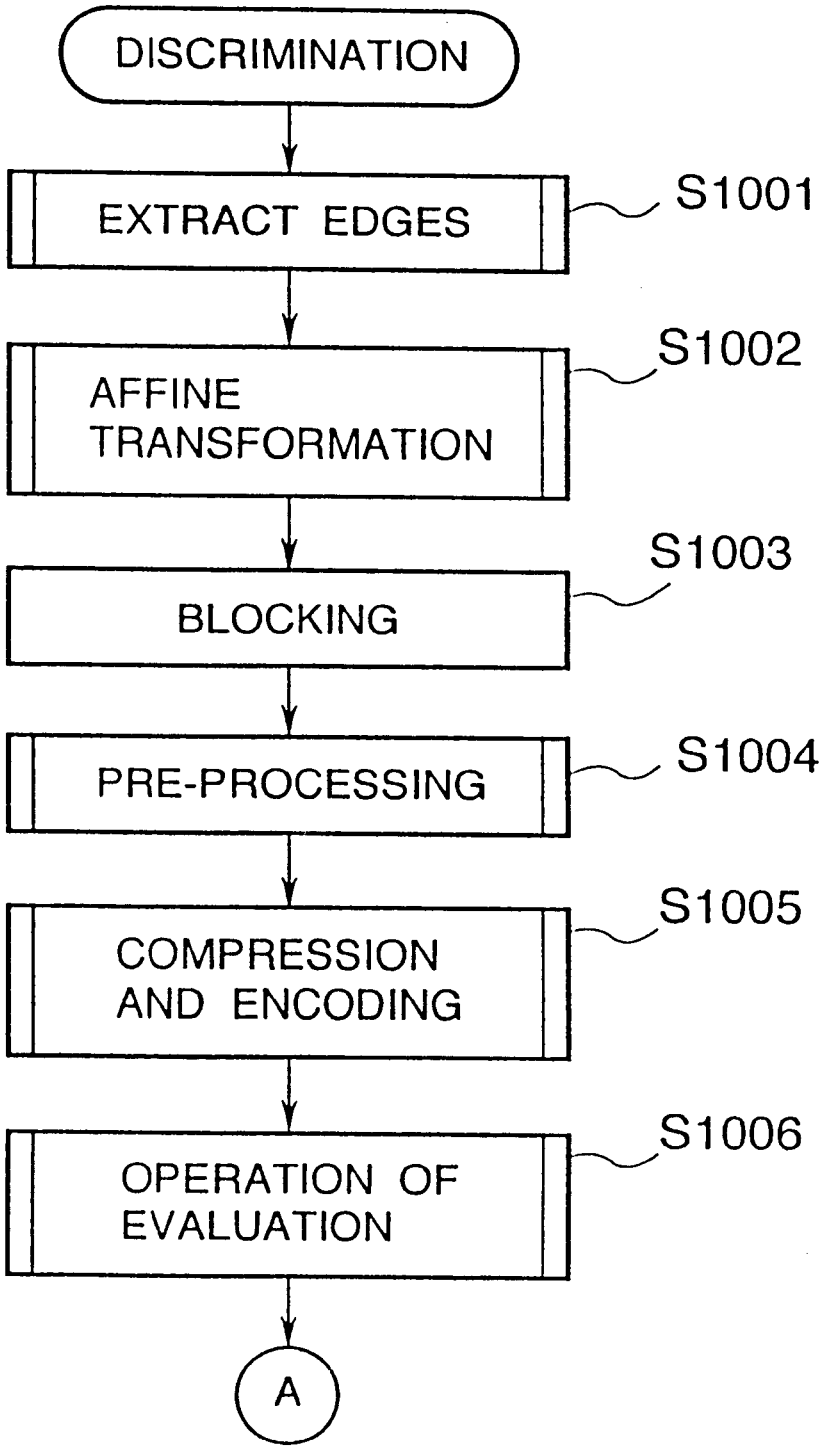
FIG. 5 is part of a flow chart to show an example of the bill discriminating operation of the present invention.
Figure 6:
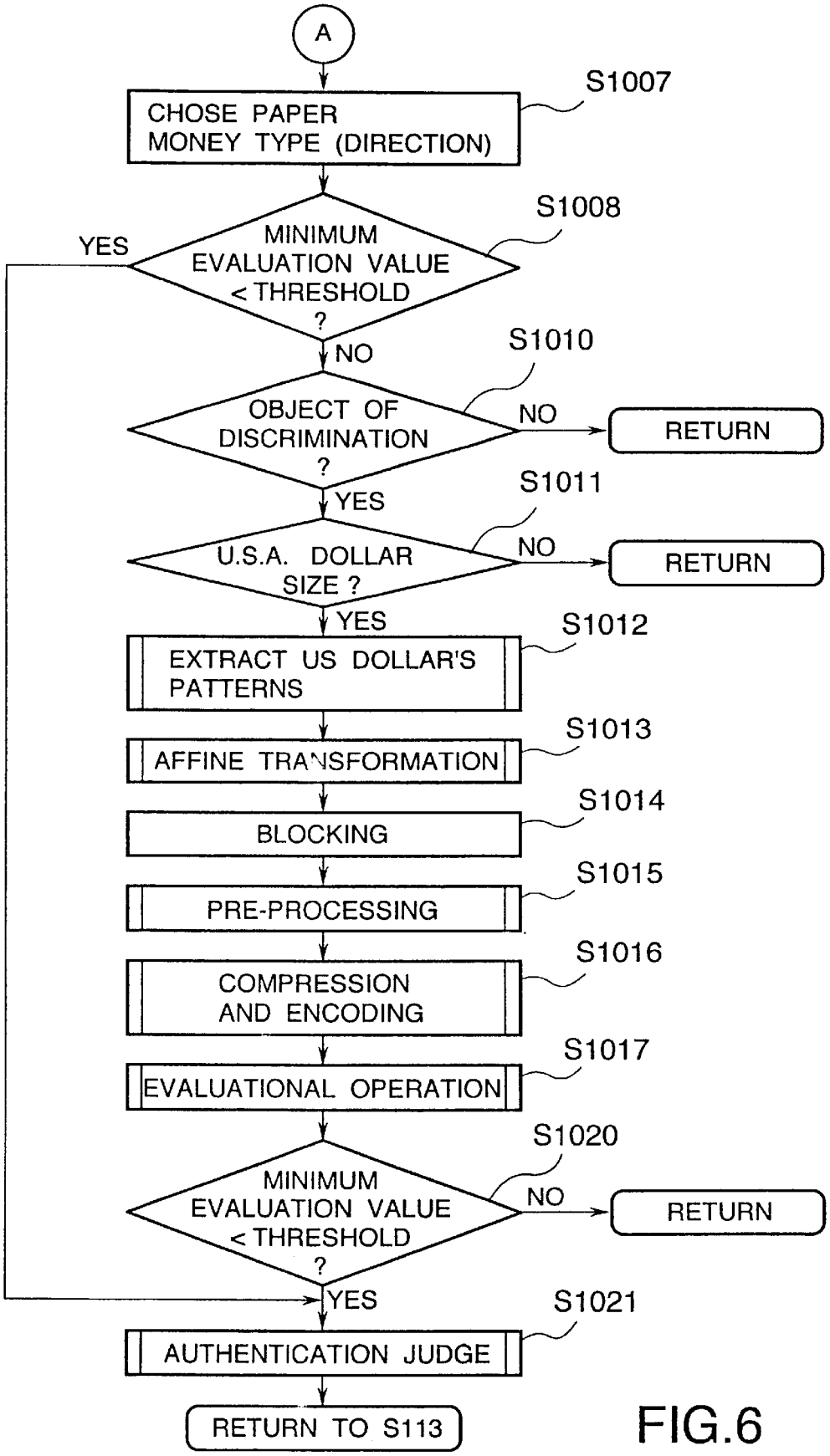
FIG. 6 is part of a flow chart to show an example of the bill discriminating operation of the present invention.

When the collection of the data of a sheet of image is completed, the double buffers will be switched (Step S111). That is, one buffer which is the data collected region of the main memory 12 is switched to a discriminating region, and the other buffer where the discrimination has been completed is switched to a data correlating region for the bill to be discriminated next. Permission of this switching is executed by enabling an interruption of the passage sensor 7. With this, the double buffers are put in a data collection stand-by state (Step S112) for the bill to be discriminated next. Based on the collected data, the bill discrimination shown in detail in FIGs. 5 and 6 is performed (Step S1000), and a discrimination result DR is sent out from the comparison/judgment control section 103 (Step S113). The above sending of the result DR is performed by wiring the result to the dual port RAM 14 and by generating a response interruption to inform to the host CPU. Also, when the passing out of the bill 1 is not sensed at the aforementioned Step S104, it is judged if there is an end command (Step S120). If there is no end command, the Step 120 will return to the aforementioned Step S104, and if there is the end command, a discrimination end response will be sent out (Step S121). The light emitting means 2 is turned off (Step S122), and the Step S122 returns to the Step S3 in FIG. 3.

Note that the aforementioned correction of the analog video signal VSB which is fetched from the line sensor 3 and stored in the main memory 12, is performed in the DSP 100 as follows. A black level is worked out with both (1) the data previously stored and prepared in the flash memory 13 by executing an additionally provided RAS command and (2) the data taken in by running a data acquiring program by turning off the light emitting means 2 when the discrimination is started. A white level is worked out with the data previously stored and prepared in the flash memory 13 by executing the additionally provided RAS command. Predetermined white paper is attached to the front face of the sensor module 4, and the data collection program specified by the RAS is executed. The output of the line sensor 3 at that time is taken in, and the aforementioned black level and white level correction data are processed by averaging a plurality of outputs of the same channel with the DSP 100. The processed data is written in the flash memory 13 by the DSP 100. At the time of the discrimination, an arithmetic operation is performed for each pixel In with the following equation (1), based on the correction data written in the flash memory 13, and the corrected pixel value CRn of the corrected n-th pixel is obtained.

$$CRn=G\times((165/(Wn-Bn))\times((In-BKn) \tag{1}$$

where

G: Data of the first bit of each line, that is, a gain G determined by both the data of received light due to the reflection from white tape and the data of the first bit due to the reflection from the white tape stored in the flash memory 13. On the 1 through 5 channels of the line sensor 3, a reference white tape is attached in a corner of the sensor module 4 so that a quantity of light can be corrected. The gain G is set so that the A/D value of the output of the line sensor 3 at the time of the initialization in assembly and the A/D value of the present output of the line sensor 3 become equal to each other. Also, the term "(165/(Wn−Bn))×(In−BKn)" is used to compensate the fluctuations in a voltage representative of the correction between channels of the line sensor 3, in environment such as temperature, and in a specular change.

Wn: Average value of several sampling results of the white level of the n-th channel. This value is stored in the flash memory 13.

Bn: Average value of several sampling results of the black level of the n-th channel. This value is stored in the flash memory 13.

BKn: Average value of several lines (several scans) of the black level of the n-th channel collected in the state when the light emitting means 2 is turned off at the time of the discrimination start.

In: Image data of a discriminate bill of the n-th channel (image data to be corrected), and "n" represents channel Nos. 6 through 95.

Figure 7:
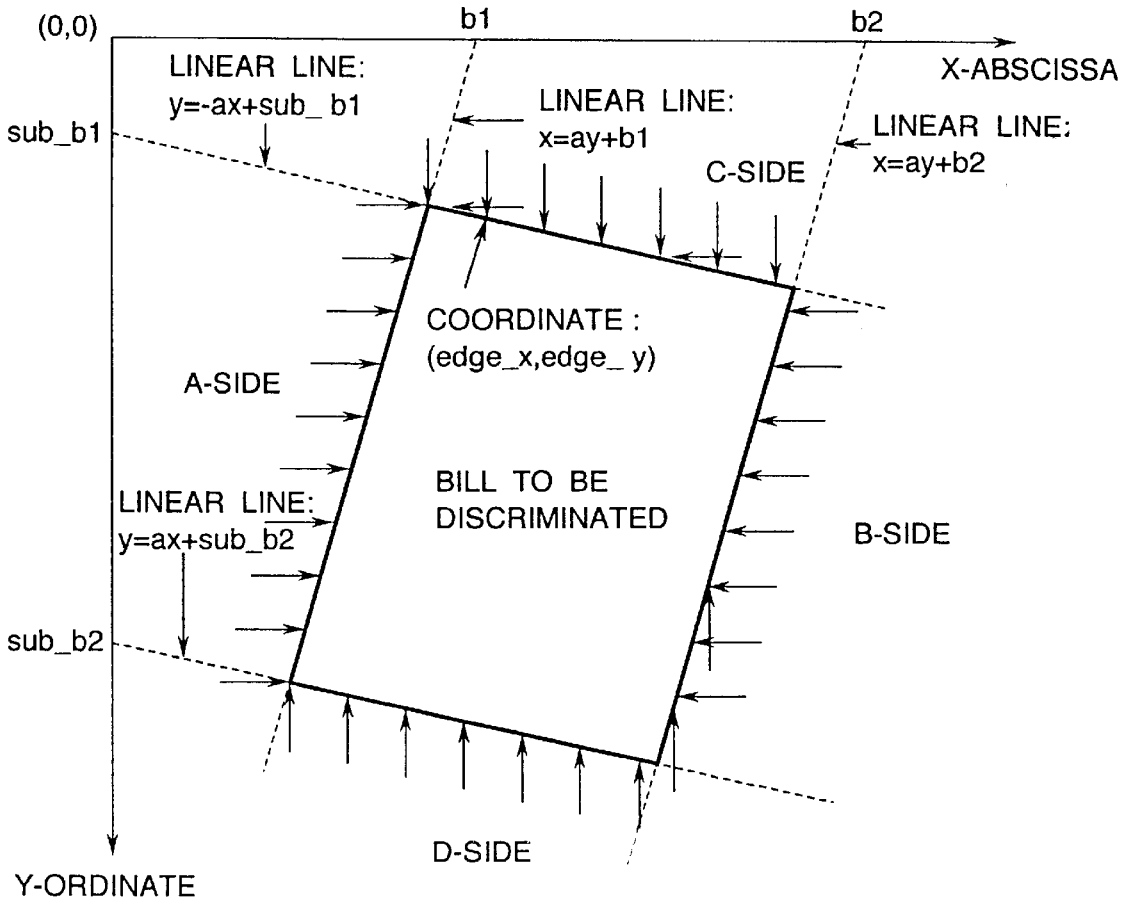
FIG. 7 is a diagram for explaining the edge extraction of bills.

The bill discrimination at the Step S1000 is executed according to the flow charts shown in FIGS. 5 and 6. First, the edges of the bill 1 are extracted (Step S1001). The edge extraction, as shown in FIG. 7, is performed by first scanning through the discrimination object bill in directions A and B to extract edges (A-edge and B-edge in the figure), and the left and right edge sides of the bill are obtained according to the following equation (2).

$$\left.\begin{aligned} A\text{-side: } x &= a\cdot y + b1 \\ B\text{-side: } x &= a\cdot y + b2 \end{aligned}\right\} \tag{2}$$

The above equation (2) is led based on the following reasons. That is, the B-side is scanned in direction X at a predetermined interval Y and a side coordinate (Xbn, Ybn) is obtained. The side coordinate (Xbn, Ybn) is developed (Huff transformation) to a U-V plane in accordance with equation (3) shown below. Scope of V at the development time is determined based on the passage and bill size.

$$V=Ybn\cdot\cos(U)+Xbn\cdot\sin(U) \tag{3}$$

The coordinates V2 and U2, of which the number of intersection points are maximum in the U-V plane, are obtained and then a linear line of the B-side is obtained based on the coordinates V2 and U2 as follows:

$$\left.\begin{aligned} a &= -\cos(U2)/\sin(U2) \\ b2 &= V2/\sin(U2) \end{aligned}\right\} \tag{4}$$

Therefore, an equation of the B-edge in the equation (2) is obtained.

Similarlly, the A-side is scanned in the direction X at the predetermined interval Y and an edge coordinate (Xan, Yan) is obtained. Since the A-side line is parallel to the B-side line, an inclination a is the same and an intersection for X-axis is obtained. The edge coordinate (Xan, Yan) is substituted for equation (5) shown below and an intersection histogram bA2n for the X-axis is obtained.

$$bA2n=Xan-a\cdot Yan \tag{5}$$

The number of candidate B1 of which the intersection histogram bA2*n* is a maximum is selected and is supposed as an X-axis intersection coordinate of the A-side line. Therefore, an equation of A-side is obtained as the equation (2) shown above.

The intersections (sub-b1, sub-b2) of the X-axis, where the number of candidates is a maximum with respect to the two lines of the aforementioned equation (2), are obtained by substituting the coordinate values of the A- and B-sides into the following equation (6). The side lines (sides C and D) of the bill in the directions being perpendicular to the lines of equation (2) are expressed by an equation (6).

$$\left.\begin{aligned} y &= -a\cdot x + \text{sub_}b1 \\ y &= -a\cdot x + \text{sub_}b2 \end{aligned}\right\} \tag{6}$$

From the aforementioned equations (2) and (6), the point of the intersections (y intercepts) between the extended lines of the C- and D-sides and a Y-axis are obtained by an equation (7).

$$\text{sub_}b1=\text{edge_}y+a\cdot edge_x \tag{7}$$

where edge_y is the y_coordinate of the A-side and edge_x is the x-coordinate of the A-side line.

From the histogram of y-intersection coordinates obtained by the equation (7), each number of candidates sub_b1 and sub_b2 which is the maximum are determined, and from the equations (2) and (6) the coordinates of each vertex are obtained by the following equation (8).

$$\left.\begin{aligned} \text{cross_}xi &= (a \cdot \text{sub_}bn + bm)/(1.0 + a \cdot a) \\ \text{cross_}yi &= (-a \cdot \text{cross_}xi + \text{sub_}bn) \end{aligned}\right\} \quad (8)$$

where cross_xi is the x-coordinate of each vertex (i=1 through 4), cross_yi is the y-coordinate of each vertex (i=1 through 4), "a" is the linear gradient of the A- or B-side lines, "bm" is the x-axis intercept of the extension line of the A-side or B-side (m=1, 2), and sub_bn is the y-axis intercept of a line in the direction of the C-side or D-side (n=1, 2).

Figure 8:
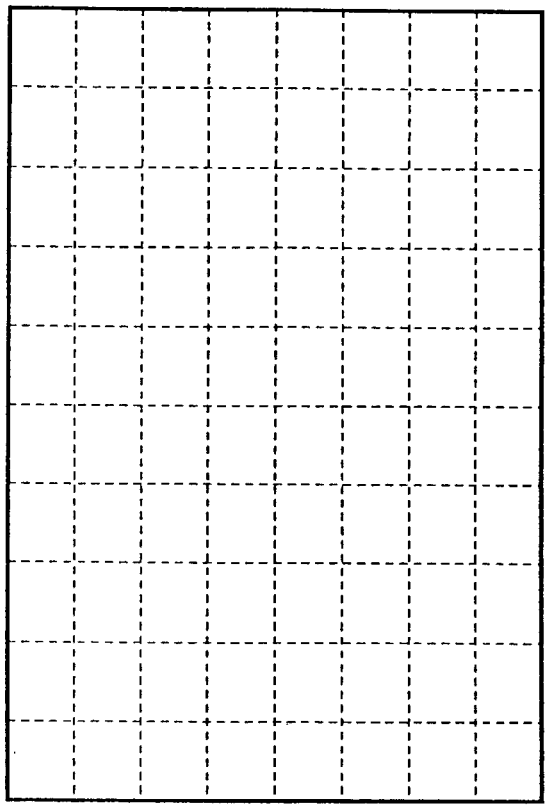
FIG. 8 is a diagram to show an example of the blocking operation of a bill.

After the edges of the bill 1 are extracted in the aforementioned way, the movement of the bill image data is performed by the rotation and movement obtained by vector calculation (affine transformation) so that the correction of the oblique lines and the movement of the image data to the origin will be started (Step S1002). Therefore, the bill image data of a vertex at which the image of the bill is started is stored at the memory position which becomes the origin in a memory device. Then, for the data of the bill region, as shown in FIG. 8, an image region with a size of horizontal direction of 2 [mm] and vertical direction of 4 [mm], for example, (2 pixels×4 pixels) is taken to be 1 block. A maximum of 48×48 block regions are reserved on a memory device, and the data of the bill are converted to block values and stored therein (Step S1003). Pre-processing is performed by making a calculation in accordance with the following equation (9) in order to obtain an average block value avg_img over the entire region of the block value img[i][j] after the affine transformation and blocking of the corrected pixel value Crn of coordinates (i, j) shown in FIG. 9. The coordinate position of the block is (y=i, x=j) where "i" is the final vertical block coordinate (Y−1) determined by i=1 to bill size and "j" is the final horizontal block coordinate (X−1) determined by j=1 to bill size (Step S1004). The average value of the bill image block portions is obtained by dividing the sum total of each block value img[i][j] by the total number of blocks.

$$\text{avg_}img = \sum_{i=0}^{Y-1}\sum_{j=0}^{X-1} img[i][j]/Y \cdot X \quad (9)$$

where Y and X represent the number of blocks in the y- and x-directions of the image obtained by correction of oblique lines.

Figure 9:
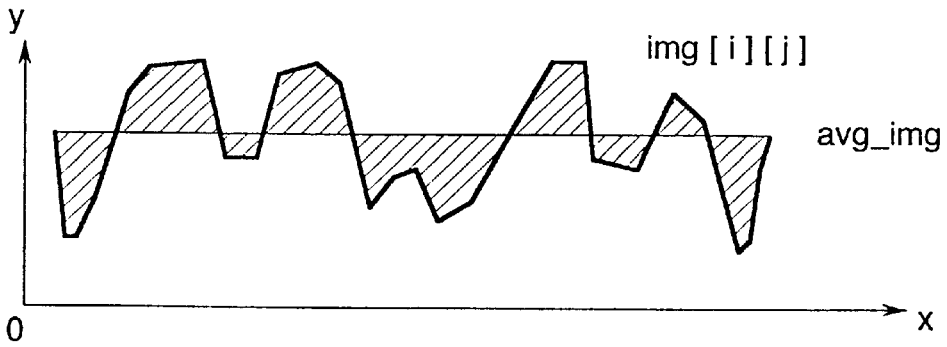
FIG. 9 is a diagram for explaining the preprocessing of the image data of the present invention.

Next, the average rate or distance avg_dis of the absolute value of the deviation from the average value of each block is obtained by calculating the sum total of the absolute value of the difference between each block value img[i][j] and the average value; avg_img of each block obtained by the equation (9) and then dividing the calculated sum total by the total number of blocks. Next, the average distance avg_dis of the block value img[i][j] and the distance from the average block value avg_img, that is, the average of the shaded portions of FIG. 9, is calculated according to an equation (10) by employing the average block value avg_img of the equation (9). With this, an offset common to respective block values, for example, the DC component of an electric circuit is cancelled, and an average of absolute values from an average value of patterns (e.g., an average value of AC components of an electric circuit) is calculated.

$$\text{avg_dis} = \sum_{i=0}^{Y-1}\sum_{j=0}^{X-1} |img[i][j] - \text{avg_}img| / Y \cdot X \quad (10)$$

where Y and X represents the number of blocks in the y- and x-directions of the image obtained by correction of oblique lines.

Next, each block value img[i][j] is normalized by dividing a deviation value, i.e., the average block value avg_img subtracted from each block value img[i][j] by the average block value avg_img. Then, according to the following equation (11), the gain and offset which effect on the bill image data are cancelled and the normalized block value; NB[i][j] is obtained.

$$NB[i][j] = \{\text{img}[i][j] - \text{avg_img}\}/\text{avg_dis} \quad (11)$$

where "i" represents the block position number 0 to Y−1 in the y-direction, "j" represents the block position number 0 to X−1 in the x-direction, and X and Y represent the number of blocks in the y- and x-directions of the image.

If the pre-processing ends in the aforementioned way, the pre-processed normalized block value NB[i][j] will be compressed and encoded (Step S1005). FIGS. 10A to 10C are diagrams for explaining the compression encoding based on the present invention. FIG. 10A shows a row of the normalized values NB[i][j] in an x direction after the scanned image data of a plurality of lines of the line sensor 3 are blocked for the bill 1, and if the normalized block values of this row are visually shown, they will become as shown in FIG. 10B. In the present invention, divided level ranges AR1 through AR4 consisting of four regions are allocated to the above normalized block value NB[i][j]. Among the level ranges AR1 through AR4, the region where the normalized block value NB[i][j] exists is taken to be "1" and the region where the normalized block value does not exist is taken to be "0". The level ranges are encoded by allocating "0" or "1" in order of the level range AR1 to the level range AR4. As a result, the level ranges are binary-coded by allocating "1" only to the level range in which the normalized block value exists and "0" to each of the other ranges. For example, when the image data is present in the level range AR2, "0100" is obtained. Therefore, as shown in FIG. 10C, the level of the normalized block value of each block can be expressed with 4-bit code. The bit position indicates the level range.

Therefore, the data of 1-pixel of 256-gray levels expressed with 8 bits, fetched from the A/D converter 5, is blocked into a block of 2×4 and compression-coded to a 4-gray level expressed by 4 bits. Thereafter, compression processing, including the compression (compaction) of the number of steps (processing time) which is performed by the DSP 100, is performed by putting together 8 blocks each having a code train of 4 bits and handling a code train of 32 bits as 1 word. Here, the level ranges AR1 through AR4 are values stored in the flash memory 13 by previously determining an optimum range with external simulation.

In the aforementioned way, the compression encoding of each normalized block processed from the image data is ended (Step S1005). The compression-coded word value is called the cluster value and expressed by CS[i][k]. Here, a relation of k=j/8 (only the quotient of division is applied to k) is established.

$$RG[i][k] = CS[i][k] \wedge \overline{RC[i][k]} \quad (12)$$

where "i" represents the cluster position number 0 to Y−1 in the y-direction (the same as the block position), "k" represents the cluster positions 0 to (X−1)/8 and there are units in the x-direction, and X and Y represent the number of blocks in the y- and x-directions and a unit is made of 8 blocks.

The above equation (12) is an equation for explaining the comparison of a reference code pattern train, stored in the flash memory 13 by tabling it in each direction of the denomination of the bill which is a discrimination candidate at an evaluating position, with a 1 cluster. The AND (logical product) is taken between the cluster value CS[i][k] and NOT (negation) of a reference coded cluster value RC[i][k] to be described later, and for the all data from a sheet of bill, if the result of the logical product is other than "0", the judgment result is taken to be "1", and if the result is "0", the judgment result is taken to be "0". The clusters where the judgment result at that position is "1" are totaled and stored on an evaluation value table. This processing is performed for all of the paper money types and directions of the bill, as a candidate for judgment exclusive of U.S. dollars (Step S1006). Thereafter, the evaluation table is retrieved to select the paper money type (direction) whose evaluation value is a minimum (Step S1007), and it is judged if the minimum evaluation value, which is minimum among evaluation values for each paper money type (direction), is within a threshold value (Step S1008).

If the minimum evaluation value is within the threshold value, the money type will be settled and this procedure will advance to the Step S1021 for authentication judgment. If the minimum evaluation value is outside the threshold value and there is no corresponding paper money type, it will be judged if a U.S. dollar bill has been an object of discrimination (Step S1010). If the U.S. dollar bill is not an object of discrimination, this procedure will return to the beginning (Step S113). If the dollar bill is the object of discrimination, it is judged if sensed data is U.S. size (Step S1011). The reason why only U.S. bill has additional algorithm is that the discrimination accuracy is sensed by extracting and evaluating only the pattern portion of the bill, because printing shift often occurs in the U.S. dollars and also similar patterns among different denominations of U.S. dollar exist. Furthermore, in the DSP 100, 8 blocks each having 4 bits per block are put together by a clustering operation and the processing is performed in units of a word (32 bits), thereby reducing the number of processing steps in the DSP 100 so that the operating speed is raised. In the discrimination processing of whether a type of paper money is a desired type, one array between a cluster value CS, which is a coded pattern array of all compression-coded, normalized blocks and a corresponding negated value of a cluster value RC, which is a reference code pattern array of all normalized blocks within the main memory 12 obtained by a learning process (to be described later), that is, the logical product of 32 bits (logical product of 8 blocks in the original blocked value), is taken. When the logic product is not "0", an evaluation value is incremented. The logic product of 32 bits is taken and the evaluation value in so-called word, where the results are all "0" or other than "0", is obtained. That is, when all are "0", the result of judgment is "0", and in the case other than that, the result of judgment is "1". The judgment in one pattern can be understood from the equation of getting the result of judgment of the equation (13). The evaluation value of a bill is the added value of "1" or "0" which is the each judgment result of a plurality of cluster values. If the numerical value of the above evaluation value is large, it will indicate that there are a great number of clusters which are inconsistent with each other and also indicate that there is a long distance between a reference pattern and the pattern of a discriminated bill to be discriminated. Here, the judgment result being "0" means that the values of 8 blocks of a corresponding region have all been within a region indicated by cluster value RC[i][k] which is a reference pattern, and the result of judgment being "1" indicates that at least any of corresponding blocks has been away from a reference pattern (paper money type or direction is different, or bill is not an object of discrimination). The minimum distance here is referred to as a calculated evaluation value of a discriminated bill which is smallest among the evaluation values each obtained by adding "1" if the result of each block calculated by the logic operation of the equation (12) is not "0". The evaluation values are comprised of the total number of blocks each having "1". The operation of the aforementioned equation (12) is executed for all types of paper money to be discriminated, and if the evaluation value is smallest, as described above, and less than a predetermined threshold, the classification result (i.e., paper money type and direction of the evaluated bill) will be outputted as the discrimination result.

In the case of the U.S. dollar in the aforementioned Step S1011, the pattern portion is first extracted (Step S1012). As mentioned above, the affine transformation (Step S1013), the blocking (Step S1014), the pre-processing (Step S1015), and the compression and encoding (Step S1016) are executed, and the evaluation values are stored in sequence (Step S1017) on the evaluation table which is provided for each object of the discrimination candidates where no arithmetic operation for the evaluation is performed. Then, the minimum evaluation value is retrieved and it is judged if the corresponding paper money type candidate is present, based on whether or not the evaluation value is less than a predetermined threshold (Step S1020). If the corresponding paper money type is not present within dollar bill values, this procedure will return. If the corresponding paper money type is present, the authenticating discrimination processing is executed based on the data of the paper money type (Step S1021).

Figure 11:
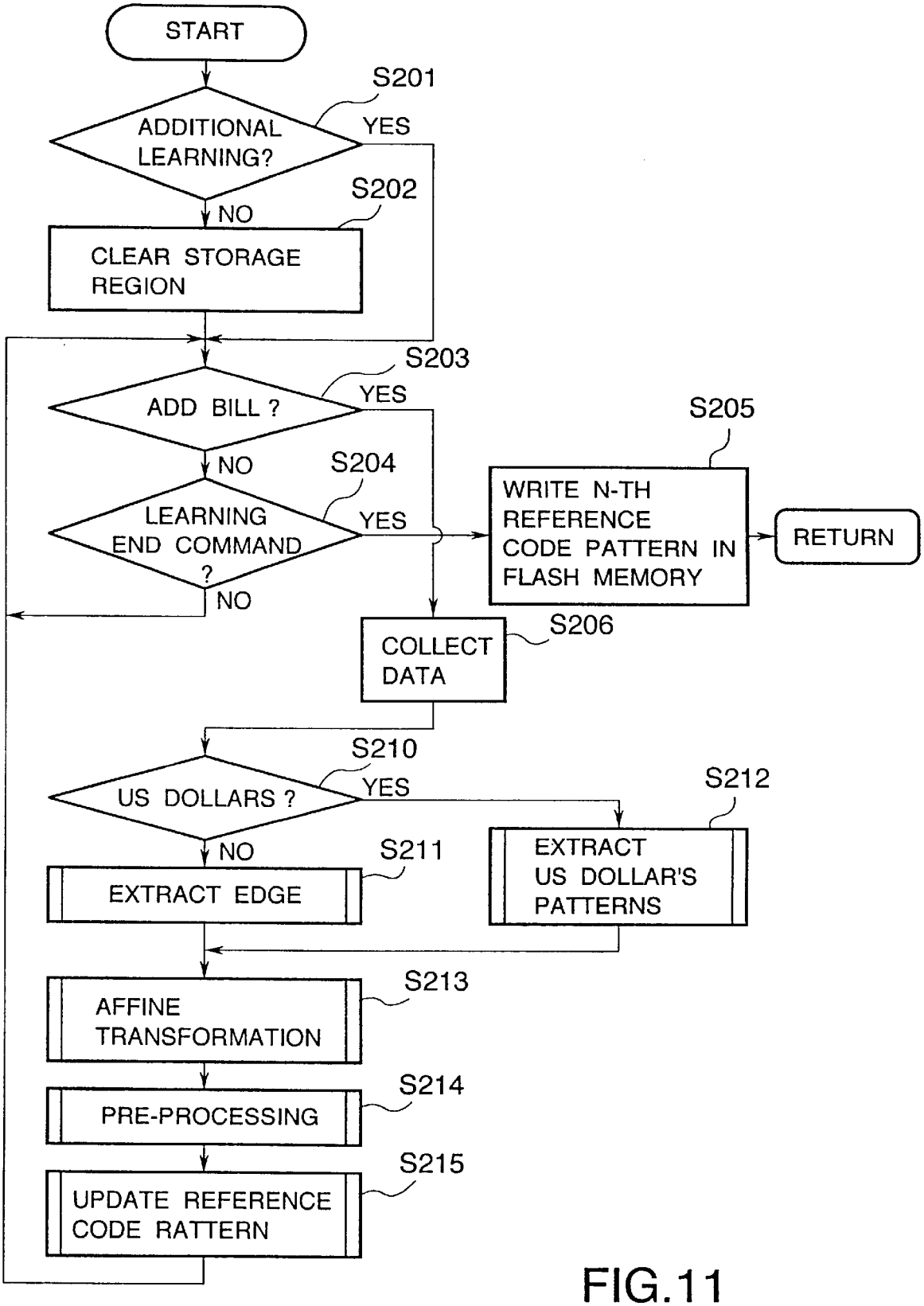
FIG. 11 is a flow chart to show an example of the learning operation of the present invention.

On the other hand, the learning process in the Step S200 is executed according to a flow chart shown in FIG. 11. Code pattern arrangement CS, which is compression-coded, are prepared for a plurality of sheets, and a reference code pattern arrangement RC of each discrimination object of paper money type is created according to the OR (logical sum) operation expressed by the equation (13).

$$RC[i][k] = RC[i][k] \vee \overline{CS[l][i][k]} \quad (13)$$

where "1" represents the number of bill to be learned (in the case of n-sheets, l=1 to n), "i" represents the block positions 0 to Y−1 in the y-direction, "k" represents the cluster positions 0 to (X−1)/8 and there are 8-block units in the x-direction, and X and Y represent the number of blocks in the y- and x-directions and a unit is made of 8 blocks.

By the learning process based on the aforementioned equation (13), a cluster value RC which is a reference code pattern is created for each paper money type direction. That is, a logical sum is taken between the cluster value CS[i][k] obtained by blocking data in the same direction for the bill of the same paper money type and the cluster value RC[i][k] stored when the sheet of one kind of banknotes before is learned, and the logical sum is updated as a new cluster value RC[i][k]. Although the range of the block values sometimes fluctuates due to various fluctuations of a regular bill, this is allowed as a reference code pattern. Then, the reference code pattern RC is written in the flash memory 13.

In the learning process, an instruction for the new learning of the n-th pattern (paper money type and direction) or additional learning is received from the host CPU. Then, it is judged if the instruction is an instruction for the additional learning (Step S201). In the case of new learning, a storage region for the n-th pattern learning result is cleared (Step S202). Thereafter, at the aforementioned Step S201, when it is judged that the instruction is the instruction for the additional learning, by the passage sensor 7 it is judged if a passage of bill is sensed (Step S203). When the bill has not passed, it is judged if a learning end command is present (Step S204). If the learning end command is present, the n-th reference code pattern is written in the flash memory 13, and this procedure will return and end (Step S205). If the learning end command is not present at the Step S204, this procedure returns to the aforementioned Step S203. Also, if a passage of the bill is sensed at the aforementioned Step S203, it is judged if the received instruction is one which has specified U.S. dollar bill (Step S210). In the case of the U.S. dollar bill, the patterns of the bill are extracted (Step S212). If the received instruction is not one for the U.S. dollar bill, similar edge extraction as the aforementioned is performed (Step S211). Thereafter, the affine transformation (Step S213) and the pre-processing, such as the correction of oblique lines and the last movement of the image data are executed (Step S214). With the processing at the time of the discrimination described by employing FIGS. 5 and 6, a logical sum is taken between a cluster value CS[i][k] obtained by blocking, compression and encoding and a cluster value of the same block of 1 sample sheet previously obtained according to the equation (13), and the logical sum is updated as the cluster value RC[i][k] of a new reference code pattern. This operation is performed for the clusters of the entire surface of the bill (Step S215), and this procedure returns to the aforementioned Step S203.

In the learning process, by expressing 1 block value with 4 bits and performing the learning based on a logical sum, the range of the block value of the bill, which should be a regular reference, can be easily learned. In addition, since a block value that is handled is normalized, it is immune to the fluctuations dependent upon the hardware of the bill validator, a change with the lapse of time and environmental change.

Figure 12:
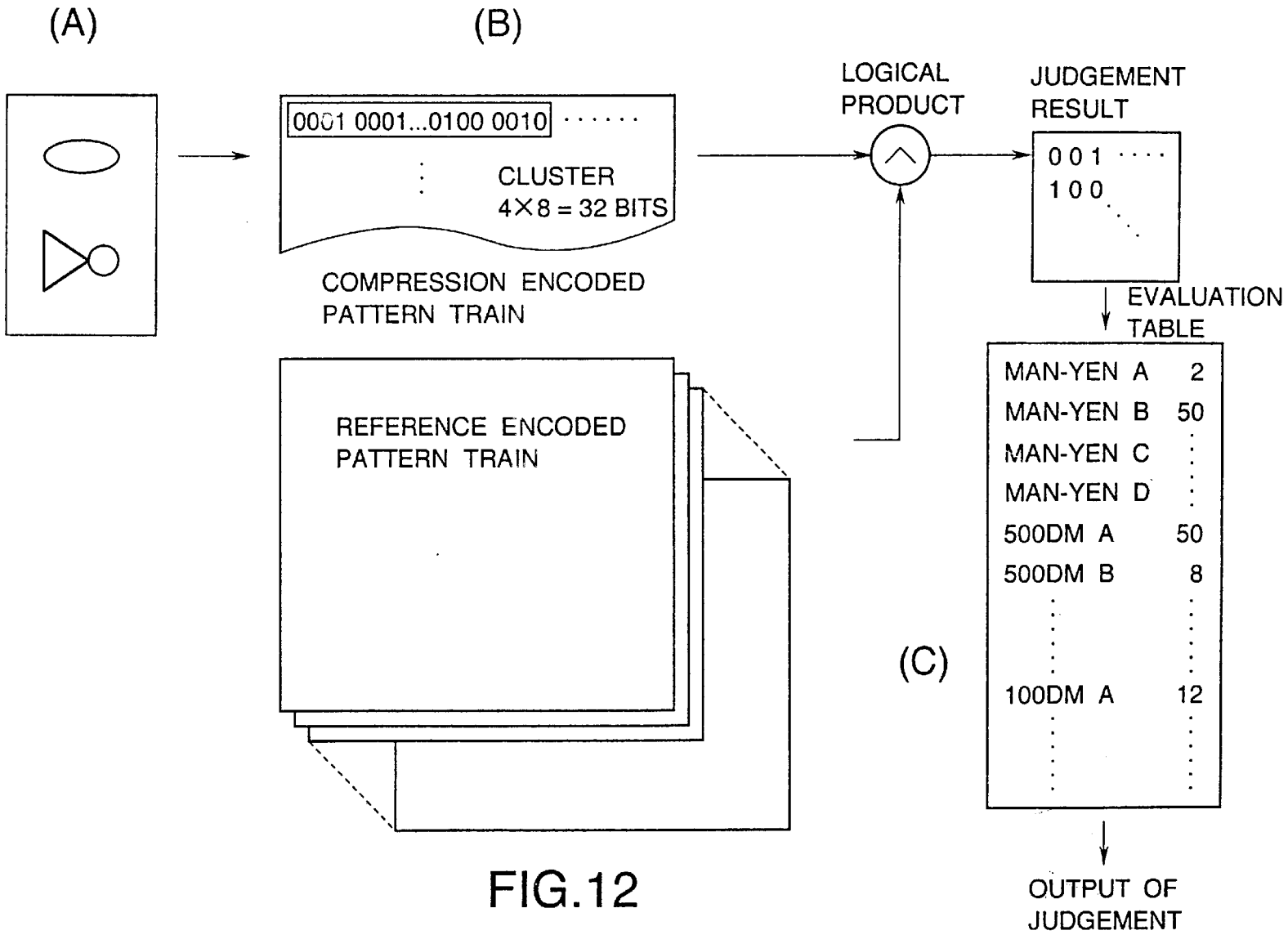
FIG. 12 is a diagram for explaining an embodiment of the present invention.

The compression code pattern distance calculation method employed in the present invention is advantageous in that the encoding bits for expressing each blocked image data with the minimum number of bits are used for bill discrimination. That is, if the pixel value of a corresponding block is normalized so as to be universal and is expressed with less code bits (actually, it is expressed with a digital value consisting of "0" and "1"), the compressibility will be high. In addition, the discrimination time will be shortened and the memory size will be reduced. Therefore, the length of the code bit, which is able to discriminate a paper money, is determined based on whether the identification is possible if a code bit has. Also, it is determined what range each code requires to extract features. By executing the simulation for the discrimination simulation, 4 bits have been determined. The example is shown in FIG. 12. A part (A) in FIG. 12 shows a bill, and the patterns after the compression encoding of the image data of the pattern portion become "0001 0001 0001 0010. . . ," as shown in (B). The reference code pattern has 4 types, an A-pattern through a D-pattern, because images in four directions exist with respect to one type of a bill. For an evaluation value (C) in FIG. 12, the A-pattern is "0", and the discrimination result indicates that the evaluation value of the A-pattern is smallest (similar). The aforementioned arithmetic operation is executed for the entire region of the bill, and if a pattern is a pattern whose evaluation value is small and the evaluation value is less than a predetermined value, the evaluation value is outputted as the discrimination result.

As has been described above, the discrimination method according to the present invention can reduce the size of a memory device that is used for each paper money type being discriminations, so discriminated of multiple patterns and money type discriminations at a high speed are possible. While this embodiment has been described with reference to bills, the present invention is likewise applicable to paper sheets such as checks and the like.

What is claimed is:

1. A method of discriminating a paper note, said method comprising:

receiving reflected light or transmitted light from the paper note by an image sensor to thereby obtain image data, and storing the image data in a memory device;

cutting out a region of the paper note from the image data of the memory device;

pre-processing the cut-out paper note image data to divide it into blocks;

compression-encoding the pre-processed data of each of the blocks to form pattern data; and comparing the compression-coded pattern data with pre-stored paper note pattern data as reference pattern data to discriminate the paper note;

wherein the blocking process is performed by extracting edges of the paper note and calculating vectors with an affine transformation.

2. A method as claimed in claim 1, wherein said pre-processing is performed by obtaining an average block value over an entire region of each block value of the image of paper notes after the blocking process.

3. A method as claimed in claim 2, further comprising obtaining a sum total of an absolute value of a difference between each block value and the average block value and obtaining an absolute average distance by dividing the calculated sum total by a total number of the blocks.

4. A method as claimed in claim 3, further comprising normalizing each block value by dividing a deviation value, which is obtained by subtracting the average block value from each block value, by the absolute average distance.

5. A method of discriminating a paper note, said method comprising:

receiving reflected light or transmitted light from the paper note by an image sensor to thereby obtain analog image data;

converting the analog image data into digital image data comprising at least 256 bits of gradation;

storing the digital image data into a memory device with a FIFO double buffer;

cutting out a region of the paper note from the digital image data read from one of the FIFO double buffers of the memory device;

dividing the digital data of the cut-out paper note into blocks;

normalizing values of the blocks;

compression-encoding the normalized values of the blocks to coded data having 4 digits comprising 0 or 1's in positions depending on an amplitude of the normalized values;

repeating said compression-encoding for all of the normalized values of the blocks;

obtaining compression-coded pattern data as a cluster value having a 32 bit word by combining the 4 digit coded data for 8 of the blocks; and comparing the compression-coded pattern data with prestored paper note pattern data of a selected area as reference pattern data to discriminate the paper note.

6. A method as claimed in claim 5, further comprising a learning and reference pattern data formation process to either add additional reference pattern data or modify the existing reference pattern data.

7. A method as claimed in claim 5, wherein in the comparing step, a logical product is taken between the compression coded pattern data and a logically negated value of the reference pattern data for each unit consisting of a plurality of blocks, and the number of units where the result which is other than "0" is counted for a sheet of the paper note and is stored, and wherein the comparison of the compression-coded pattern data with the reference pattern data is executed only for a reference pattern of discrimination, where the stored number is minimum and less than a predetermined number, are the discrimination results of a corresponding paper note.

8. A method as claimed in claim 6, wherein said learning and reference pattern data formation process comprises:

determining whether or not a new paper note is added;

judging the presence of a learning end command if the new paper note is not added;

collecting image data if the new paper note is added;

deciding whether or not the collected image data is that of U.S. currency;

extracting edge data if the collected image data is not that of U.S. currency;

extracting the U.S. currency patterns if the collected image data is that of U.S. currency; and performing an Affine transformation, pre-processing, and an updating of the reference code pattern.

9. A method as claimed in claim 8, wherein in the reference pattern data, a logical sum of the compression coded pattern data of a paper note which becomes an object having an output as a discrimination result is sequentially taken, and is stored as the reference pattern data of the paper note.

* * * * *